United States Patent [19]

Scott

[11] 4,159,937

[45] Jul. 3, 1979

[54] MIXED-PHASE REACTION PRODUCT EFFLUENT SEPARATION PROCESS

[75] Inventor: Norman H. Scott, Arlington Heights, Ill.

[73] Assignee: UOP Inc., Des Plaines, Ill.

[21] Appl. No.: 938,182

[22] Filed: Aug. 30, 1978

[51] Int. Cl.[2] ..... C10G 37/06; C10G 37/02

[52] U.S. Cl. ..... 208/104; 208/58; 208/59; 208/100; 208/101; 208/102

[58] Field of Search ..... 208/59, 100, 104, 93, 208/101, 102

[56] References Cited

U.S. PATENT DOCUMENTS

| | | | |
|---|---|---|---|
| 3,364,134 | 1/1968 | Hamblin | 208/93 |
| 3,371,029 | 2/1968 | Weiland | 208/102 |
| 3,371,030 | 2/1968 | Penisten et al. | 208/102 |
| 3,375,189 | 3/1968 | Hamblin | 208/59 |
| 3,402.122 | 9/1968 | Atwater et al. | 208/101 |
| 3,801,494 | 4/1974 | Moore et al. | 208/79 |

*Primary Examiner*—Herbert Levine
*Assistant Examiner*—G. E. Schmitkons
*Attorney, Agent, or Firm*—James R. Hoatson, Jr.; Robert W. Erickson; William H. Page, II

[57] ABSTRACT

Multiple-stage separation of a mixed-phase product effluent resulting from the hydrocracking and/or hydrorefining conversion of a hydrocarbonaceous charge stock. Reaction product effluent is initially separated in a high temperature, high pressure first separation zone, the vapor phase from which is cooled and separated in a second separation zone to provide a hydrogen-rich vaporous phase. The liquid phase from the second separation zone is increased in temperature and separated in a third separation zone at a substantially lower pressure. At least a portion of the liquid phase from the third separation zone is combined with the vaporous phase from the first separation zone prior to cooling and separation in the second separation zone. A savings of about 10.0% in hydrogen loss is realized or about 12 standard cubic feet per barrel of charge stock.

8 Claims, 1 Drawing Figure

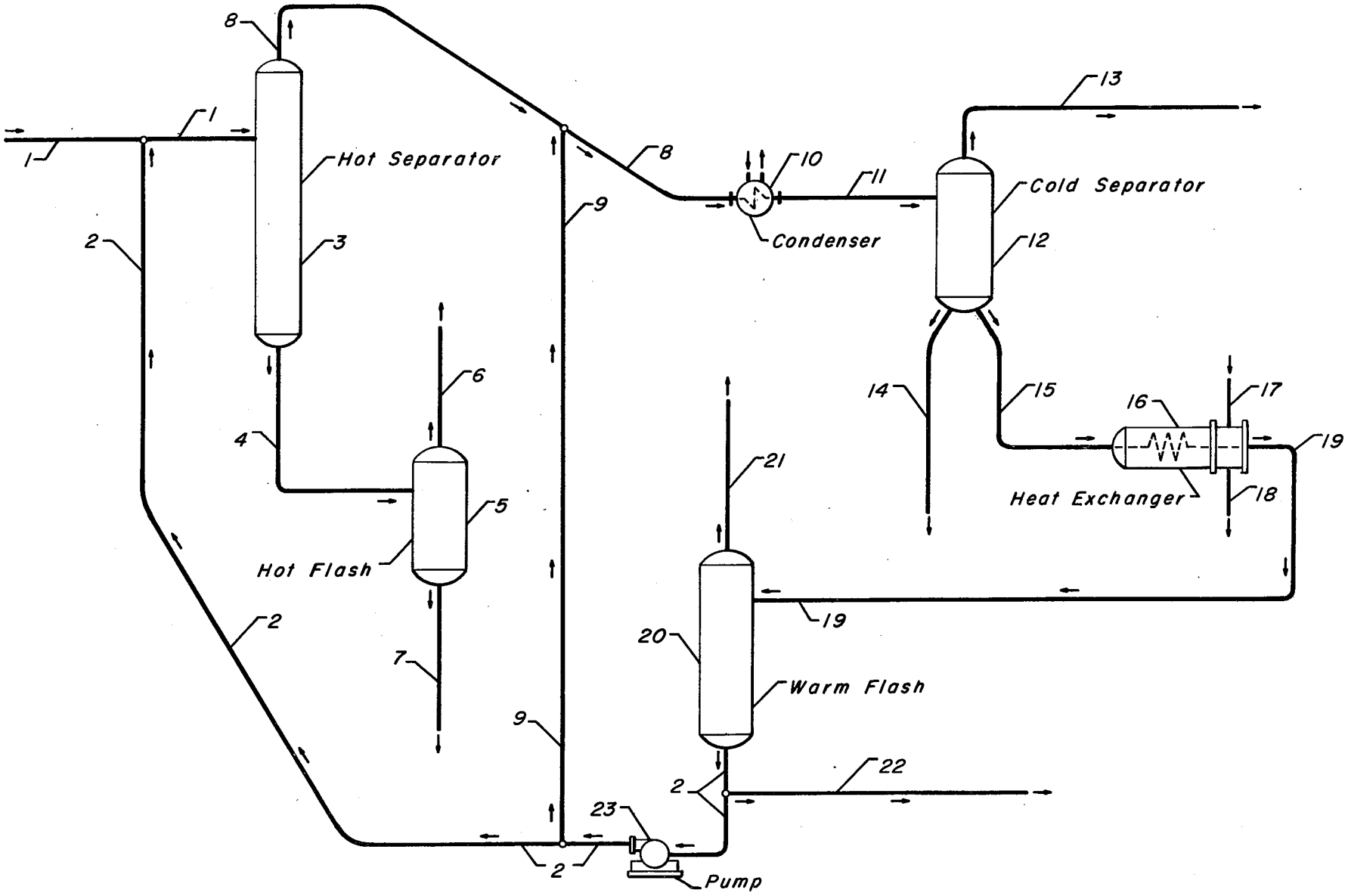
Cold Separator
Heat Exchanger
Condenser
Warm Flash
Pump
Hot Separator
Hot Flash

MIXED-PHASE REACTION PRODUCT EFFLUENT SEPARATION PROCESS

APPLICABILITY OF INVENTION

Reaction product separation as herein described is especially adaptable to a mixed-phase hydrocarbon conversion effluent. More specifically, my invention involves a particular scheme for separating a mixed-phase hydrocarbonaceous product effluent which results from the conversion of a heavier-than-gasoline hydrocarbon charge stock. The mixed-phase separation process hereinafter described in detail, is applicable to a hydrocarbon conversion process which may be classified as hydrogen-consuming, and in which processing techniques dictate the recycle of a hydrogen-rich gaseous phase to one or more reaction zones. Such hydrogen-consuming processes include the hydrorefining, or hydrotreating of kerosene fractions, middle-distillate fractions, light and heavy vacuum gas oils, light and heavy cycle stocks, etc., for the primary purpose of reducing the concentration of various contaminating influences contained therein. Another typical hydrogen-consuming conversion process is known in the petroleum refining art as "hydrocracking". Basically, hydrocracking techniques are employed to convert relatively heavy hydrocarbonaceous material into lower-boiling hydrocarbon products such as gasoline, kerosene and fuel oil.

Relatively recent developments in the area of petroleum technology have indicated that the hydrocracking reactions can be applied successfully to residual stocks, or so-called "black oils". Exemplary of such material are atmospheric tower bottoms products, vacuum tower bottoms products (vacuum residuum), crude residuum, topped crude oils, crude oils extracted from tar sands, etc. As hereinafter indicated by specific example, and by the embodiment presented for illustrative purposes in the accompanying drawing, the utilization of the present separation process affords advantages when integrated into a process for the conversion of black oils. It will be noted, however, that the foregoing brief description of petroleum processes to which the present separation process is adaptable, utilize hydrocarbonaceous charge stocks boiling above the gasoline boiling range—i.e. having an initial boiling point above about 400° F. (204.4° C.).

OBJECTS AND EMBODIMENTS

A principal object of my invention is to effect a decrease in hydrogen loss, compared to other processing schemes, while conducting a hydrogen-consuming hydrocarbon conversion process. A corollary objective is to provide a technique for separating a mixed-phase reaction product effluent resulting from the conversion of heavier-than-gasoline hydrocarbonaceous material.

Another object of the present invention is to provide an improved process for separating a mixed-phase hydrocarbonaceous reaction product effluent, which product effluent contains hydrogen, normally liquid hydrocarbons and normally gaseous hydrocarbons.

These and other objects are achieved by the present invention as more completely described hereinbelow, especially with reference to the accompanying drawing which is a simplified representation of several embodiments.

In a broad embodiment, therefore, the present invention directs itself toward a process for separating a mixed-phase hydrocarbonaceous reaction product effluent, said product effluent (1) resulting from the conversion of a hydrocarbon charge stock boiling above a temperature of about 400° F. and, (2) containing hydrogen to be recycled to the conversion zone, normally liquid hydrocarbons and normally vaporous hydrocarbons, which separation process comprises the sequential steps of: (a) separating said product effluent, in a first separation zone at substantially the same pressure as said effluent, to provide (i) a first liquid phase and, (ii) a first vaporous phase; (b) cooling said first vaporous phase to a temperature in the range of about 50° F. (10° C.) to about 150° F. (65.6° C.), and separating the cooled vaporous phase, in a second separation zone at substantially the same pressure as said first separation zone, to provide (i) a hydrogen-rich second vaporous phase and, (ii) a methane-containing second liquid phase; (c) increasing the temperature of said second liquid phase, and separating the heated liquid phase in a third separation zone at substantially reduced pressure, said temperature and pressure being selected to provide (i) a third liquid phase and, (ii) a third vaporous phase containing at least about 70.0% of the methane in said second liquid phase; and, (d) admixing at least a portion of said third liquid phase with said first vaporous phase.

In another embodiment, that portion of the third liquid phase being admixed with said first vaporous phase is commingled therewith prior to effecting the cooling thereof.

These, as well as other objects and embodiments, will become evident from the following more detailed description of the present mixed-phase separation process. In one such other embodiment, the second liquid phase is heated to a temperature in the range of about 250° F. (121.1° C.) to about 500° F. (260° C.), and said third separation zone functions at a pressure from about 200 psig. (14.61 atm.) to about 450 psig. (31.63 atm.).

Briefly, it will be noted that the present mixed-phase separation process is effected in three or four individual separation zones. Initially, the reaction product effluent is introduced into a hot separator at substantially the same pressure as it emanates from the conversion reaction zone; preferably, the temperature is at a level in the range of about 700° F. (371° C.) to about 750° F. (399° C.). The vaporous phase from the hot separator is cooled to a temperature in the range of about 50° F. (10° C.) to about 150° F. (65.6° C.), and introduced into a cold separator at substantially the same pressure under which the hot separator functions. Liquid phase material from the cold separator is heated to a temperature in the range of about 250° F. (121.1° C.) to about 500° F. (260° C.), and introduced into a warm flash zone at a substantially reduced pressure in the range of about 200 psig. (14.61 atm.) to about 450 psig. (31.63 atm.). When the fourth separation zone is utilized, it functions at substantially the same temperature as the hot separator, but at a substantially reduced pressure in the range of about 100 psig. (7.81 atm.) to about 400 psig. (28.23 atm.); this fourth zone is, therefore, known in the art as a hot flash zone. The inventive concept encompassing the separation process herein described is based upon the warm flash zone. In similar prior art separation techniques, the liquid phase from the cold separator is not increased in temperature, but is introduced into a cold flash zone at substantially the same temperature and a substantially reduced pressure.

CITATION OF RELEVANT PRIOR ART

It must be recognized and acknowledged that the prior art is replete with techniques for effecting separation of a mixed-phase reaction product effluent, particularly those which are integrated into a black oil conversion process. A perusal of the prior art Classes 208-59, 208-93, 208-101 and 208-102 indicates that such is the case. The five delineated references discussed below are appropriate to the present mixed-phase separation process; therefore, copies thereof accompany this application.

In U.S. Pat. No. 3,364,134 (Cl. 208-93), issued to R. J. J. Hamblin on Jan. 16, 1968, a black oil conversion process is described which involves four separation zones (one of which initially separates the fresh feed charge stock) and two reaction vessels. The invention is stated as encompassing a method whereby the asphaltic material in the charge stock is maintained in a dispersed state within a liquid phase which is rich in hydrogen. The fresh feed charge stock is initially separated in the first separation zone (atmospheric flash column) to provide a light fraction having an end boiling point of 650° F. (343.3° C.) to about 850° F. (454.4° C.), and a heavy fraction having an initial boiling point above about 650° F. (343.3° C.).

The heavy fraction is admixed with make-up and all the recycled hydrogen, and reacted in a first reaction zone, the effluent from which is introduced into a hot separator functioning at a temperature of about 700° F. (371.1° C.) to about 750° F. (399° C.) and at substantially the same pressure. Hot separator liquid is introduced into a hot flash separation zone at a substantially reduced pressure below about 100 psig. (7.81 atm.) and at a temperature of about 550° F. (287.8° C.) to about 900° F. (482.2° C.). Hot flash liquid is withdrawn from the process as residuum while the hot flash vapors are admixed with the hot separator vapors and the atmospheric flash light fraction, and reacted in the second reaction zone. Product effluent from the second reaction zone is introduced into a cold separator at substantially the same pressure and at a temperature of about 60° F. (15.6° C.) to about 130° F. (54.4° C.). A hydrogen-rich vaporous phase is withdrawn from the cold separator and recycled to the first reaction zone; the cold separator liquid phase is recovered as the product of the process. With respect to the foregoing described process, it will be noted that there is no recognition of additionally flash separating the cold separator liquid phase at an elevated temperature in a warm flash separation zone. Certainly, therefore, there exists no disclosure relative to the decrease in hydrogen loss.

A hot separator, cold separator and hot flash zone are utilized in conjunction with a vacuum column in U.S. Pat. No. 3,371,030 (Cl 208-102), issued to J. R. Penisten, et al. on Feb. 27, 1978. Reaction product effluent is introduced into the hot separator, the vaporous phase from which is condensed and introduced into the cold separator; hot separator liquid is introduced into the hot flash zone below a mesh blanket contained therein. The hot flash zone functions at a temperature substantially the same as the hot separator, but at a reduced pressure below about 200 psig. (14.61 atm.). This vessel serves to concentrate the 400° F.-plus (204.4° C.) hydrocarbons in a liquid phase which is in turn introduced into the vacuum column. A portion of the recovered heavy vacuum gas oil is reintroduced into the hot flash zone above the mesh blanket to function as a wash oil. Cold separator liquid is admixed with hot flash vapors and recovered as the product of the process.

The process described in U.S. Pat. No. 3,375,189 (Cl. 208-59), issued to R. J. J. Hamblin on Mar. 26, 1978, is similar to that of U.S. Pat. No. 3,364,134 summarized above. Here, however, the hot separator vapors and the hot flash vapors from a first reaction zone effluent are combined and reacted in a second reaction zone. The effluent from the latter is introduced into a cold separator, the hydrogen-rich vapors from which are recycled to the first reaction zone. Cold separator liquid components are fractionated to provide a 400° F.-plus (204.4° C.) fraction which is reacted in a third reaction zone, from which the product effluent is introduced into a second cold separator. The liquid phase from the latter is fractionated in admixture with the liquid phase from the first cold separator.

U.S. Pat. No. 3,402,122 (Cl. 208-101), issued to B. L. Atwater et al. on Sept. 17, 1968, discloses a separation technique for recovering an absorption medium from a black oil reaction product effluent. Utilized are a hot separator, a cold separator, a hot flash zone and a cold flash zone. Salient features include recovering the absorption medium from condensed hot flash vapors and also introducing cold flash liquid into the cold separator. Again, there exists no recognition of increasing the temperature of the cold separator liquid and introducing it into a warm flash zone.

A somewhat similar separation technique is presented in U.S. Pat. No. 3,371,029 (Cl. 208-102), issued to J. N. Weiland on Feb. 27, 1968. Again, four separation zones are involved: a hot separator, hot flash, cold separator and cold flash. Hot separator vapors are condensed and introduced into the cold separator, while the hot separator liquid phase passes into the hot flash zone. Hot flash zone vapors are condensed, admixed with the cold separator liquid phase and introduced into the cold flash zone at a temperature of about 105° F. (40.6° C.) and a pressure below about 200 psig. (14.61 atm.). A portion of the cold flash liquid phase is recycled to the cold separator; the remainder being admixed with the hot flash liquid phase and fractionated for desired product recovery.

From the foregoing, it becomes readily apparent that there exists no recognition of the inventive concept described herein. That is, although these illustrative processes utilize three or four separation zones for the recovery of desired product from a black oil conversion effluent, none employ the technique of increasing the temperature of the cold separator liquid phase and introducing the same into a warm flash zone at a pressure above about 200 psig. (14.61 atm.). Therefore, such prior processes cannot offer a reduction in hydrogen loss as realized by the present inventive concept.

SUMMARY OF INVENTION

From the foregoing brief description, it will be readily ascertained, by those possessing skill in the art of petroleum processing techniques, that the present invention involves a series of integrated steps for the separation of a mixed-phase reaction product effluent in a relatively simple and economical fashion. As previously stated, the present separation technique is uniquely adaptable to processes designed and intended for the conversion of hydrocarbonaceous black oils. It will, however, by recognized that the novel separation process is equally applicable to the various reaction product effluent streams which may be obtained from sources other than the conversion of such hydrocarbonaceous black oils. In further describing the present mixed-phase separation technique, illustrative conversion of the previously described black oils will be utilized. Black oil conversion is intended to accomplish primarily two objects: first, to desulfurize the feedstock to the extent dictated by the desired end product, whether maximizing fuel oil or gasoline boiling range hydrocarbons; secondly, it is intended to produce "distillable hydrocarbons", being those normally liquid hydrocarbons having normal boiling points below about 1050° F. (565.6° C.).

The separation technique herein described does not depend for viability upon the precise conditions utilized in the catalytic conversion zones; those conditions utilized in the prior art processes hereinabove delineated continue to be suitable. It will be noted by those skilled in the art of petroleum refining techniques, that these conversion conditions are significantly less severe than those being currently commercially employed in processing similar black oil charge stocks. Distinct economic advantages, over and above those normally stemming from the production of the more valuable distillable hydrocarbons will be recognized. Briefly, the conversion conditions include temperatures above about 700° F. (371.1° C.), with an upper limit of about 800° F. (426.7° C.), as measured at the inlet to the fixed-bed of catalyst particles disposed within the reaction zone. Since the bulk of the reactions being effected are exothermic in nature, the reaction zone effluent will exhibit a higher temperature. In order that catalyst stability be preserved, it is preferred to control the inlet temperature at a level such that the temperature of the reaction product effluent does not exceed about 900° F. (482.2° C.). Hydrogen is admixed with the black oil charge stock, by way of compressive means, in an amount usually less than about 10,000 standard cubic feet per barrel, at the selected operating pressure; hydrogen is present in the recycled gaseous phase in an amount of about 80.0% by volume, or more. A preferred range for the quantity of hydrogen being admixed with the black oil charge stock is about 3,000 to about 6,000 standard cubic feet per barrel. Black oil conversion requires pressures which generally exceed about 1000 psig. (69.07 atm.), and generally in the range of about 1500 psig. (103.11 atm.) to about 3000 psig. (205.22 atm.). The black oil is introduced into the catalytic reaction zone at a liquid hourly space velocity (defined as volumes of liquid hydrocarbon charge per hour per volume of catalyst disposed within the reaction zone) of from about 0.25 to about 2.0.

In accordance with the present separation technique, the black oil reaction product effluent is introduced into a first separation zone, the hot separator, at essentially the same pressure as it emanates from the reaction zone, or zones; thus, the hot separator functions at a pressure of about 1000 psig. (69.07 atm.) to about 3000 psig. (205.22 atm.). Preferably, the temperature of the reaction product effluent is not substantially in excess of about 750° F. (399° C.). At higher temperatures, the heavier normally liquid hydrocarbons tend to carry over in the vaporous phase. Similarly, at temperatures below about 700° F. (371.1° C.), ammonium salts which are formed as a result of the conversion of nitrogenous compounds will tend to fall into the liquid phase. Where a reduction of reaction effluent temperature is required, a quench stream from a subsequent colder separation zone may be admixed therewith; as indicated in the accompanying drawing, this quench stream is preferably supplied as a portion of the liquid phase withdrawn from the warm flash zone.

The vaporous phase from the hot separator is cooled and condensed at a temperature in the range of about 50° F. (10.0° C.) to about 150° F. (65.5° C.), and introduced into a second separation zone, the cold separator, at substantially the same pressure. A hydrogen-rich vaporous phase is recovered and utilized, at least in part, as recycled hydrogen to the conversion reaction zone. Generally, however, the vaporous phase is first treated in order to remove hydrogen sulfide. Cold separator liquid is increased in temperature to a level in the range of about 250° F. (121.1° C.) to about 500° F. (260° C.), and introduced into a third separation zone, the warm flash zone, at a reduced pressure in the range of from 200 psig. (14.61 atm.) to about 450 psig. (31.63 atm.). It will be recalled that this technique is contrary to that which is practiced in the previously described prior art, wherein this third separation zone is a cold flash zone which functions at substantially the cold separator temperature and a pressure below 200 psig. (14.61 atm.). Typically, a cold flash zone is maintained at a temperature of 125° F. (51.6° C.) and a pressure of about 50 psig. (4.40 atm.). Upon comparison, the higher temperature and pressure favors hydrogen retention and methane rejection. Warm flash liquid phase components are increased in pressure, and in part recycled to combine with the hot separator vapors prior to the condensation thereof, the remainder being used to quench the reaction zone effluent which is first introduced into the hot separator. Liquid components from the hot separator are introduced into a fourth separation zone, the hot flash zone, at substantially the same temperature and a reduced pressure in the range of about 100 psig. (7.81 atm.) to about 400 psig. (28.23 atm.). Hot flash zone vapors are generally introduced into a suitable hydrogen recovery facility; the liquid phase may be fractionated for normally liquid product recovery, or further converted in additional reaction zones.

As hereinbefore stated, the principal advantage afforded over the prior art techniques is directed toward a reduction in the hydrogen solution loss. By way of illustrating the significance of this advantage, a comparison will be made between (1) the prior art techniques which employ a cold flash zone on the cold separator liquid phase and, (2) the present scheme in which cold separator liquid is introduced into a warm flash zone. On the basis of a 50,000 Bbl/day charge to the reaction section (a common size for a black oil unit), the prior art scheme, using a cold flash zone at 50 psig. (4.40 atm.) and 125° F. (51.7° C.), experiences a hydrogen solution loss of about 114.8 scf/Bbl. In a unit having integrated therein the product separation facility incorporating the warm flash zone at 300 psig. (21.42 atm.) and 363° F. (183.9° C.), the hydrogen solution loss is reduced to 102.5 scf/Bbl., or about 12.0%. The daily savings in hydrogen, at 12.3 scf/Bbl., for the 50,000 Bbl/day unit, is 615,000 scf. At a current hydrogen cost basis of about $2.50/1000 scf., the daily dollar amount is about $1,537.50; since petroleum refining units are considered as functioning 330 days per year, the annual dollar savings approximates $507,375.00.

BRIEF DESCRIPTION OF DRAWING

Additional description of my inventive concept, and the separation process encompassed thereby, will be made with reference to the accompanying drawing which is presented for the sole purpose of illustration and not with the intent of limiting the same beyond the scope and spirit of the appended claims. The drawing is presented as a simplified schematic flow diagram in which details such as pumps, instrumentation and controls, quench systems, heat-exchange and heat-recovery circuits, valving, start-up lines and similar hardware have either been eliminated, or reduced in number as non-essential to an understanding of the techniques involved. Use of such appurtenances, to modify the illustrated process will become evident to those possessing the requisite skill in the art of petroleum refining technology.

DETAILED DESCRIPTION OF DRAWING

With specific reference now to the drawing, the same will be described in conjunction with a commercial unit designed to process about 50,000 Bbl/day (331.2 $M^3$/hr.) of a black oil having an API gravity of 16.3 and an average molecular weight of about 430. The reaction product effluent is withdrawn from the reaction section through line 1 at a temperature of about 800° F. (426.7° C.) and a pressure approximating 2,240 psig. (153.48 atm.), and in the amount of about 1,072,408 lbs/hr. (486,444 kg/hr). The effluent is admixed with 174,286 lbs/hr (79,056 kg/hr) of a liquid quench stream in line 2, having a temperature of about 180° F. (82.2° C.). The resulting mixture continues through conduit 1, and is introduced into hot separator 3 at a temperature of about 750° F. (398.9° C.) and a pressure of about 2,240 psig. (153.48 atm.). Hot separator 3 serves to provide a liquid phase in line 4 and a hydrogen-rich vaporous phase in line 8. As illustrated, the former may be introduced, via line 4, into hot flash zone 5 at substantially the same temperature, 745° F. (396.1° C.), but at a reduced pressure of 245 psig. (17.68 atm.). Component analyses of the total feed to hot separator 3, the vaporous phase in line 8 and the liquid phase in line 4 are presented in the following Table I in which the quantities of each component is expressed as pound moles/-hour.

Table I:

| Hot Separator Stream Analyses | | | |
|---|---|---|---|
| Component | Total Feed | Line 4 | Line 8 |
| Water | 2111.99 | — | 2111.99 |
| Hydrogen Sulfide | 899.11 | 33.36 | 865.75 |
| Hydrogen | 35208.89 | 974.51 | 34234.38 |
| Methane | 6049.90 | 187.44 | 5862.46 |
| Ethane | 493.83 | 30.16 | 463.67 |
| Propane | 228.36 | 14.73 | 213.64 |
| Butanes | 128.16 | 9.78 | 118.38 |
| Pentanes | 61.24 | 5.73 | 55.51 |
| Hexanes | 55.36 | 6.17 | 49.19 |
| Heptane-400° F. | 603.24 | 101.91 | 501.33 |
| 400° F.-650° F. | 819.65 | 455.96 | 363.69 |
| 650° F.-1050° F. | 1336.31 | 1269.94 | 66.37 |
| 1050° F.-plus | 159.16 | 159.16 | — |

Hot flash zone 5 provides a vaporous phase rich in hydrogen, in line 6, and a principally liquid phase in line 7, the latter intended to contain substantially all the unconverted 1050° F.-plus (565° C.) material. Hydrogen is recovered from the vaporous phase in line 6 (not illustrated herein), while the liquid phase in line 7 is subjected to additional catalytic conversion (not illustrated herein). Component analyses of the two hot flash zone streams are given in the following Table II; again, the numerical values are in pound moles/hour.

TABLE II

| Hot Flash Zone Stream Analyses | | |
|---|---|---|
| Component | Line 6 | Line 7 |
| Water | — | — |
| Hydrogen Sulfide | 30.19 | 3.18 |
| Hydrogen | 907.14 | 67.37 |
| Methane | 174.03 | 13.41 |
| Ethane | 25.40 | 4.76 |
| Propane | 12.07 | 2.65 |
| Butanes | 7.63 | 2.16 |
| Pentanes | 4.17 | 1.56 |
| Hexanes | 4.20 | 1.96 |
| Heptane-400° F. | 57.20 | 44.71 |
| 400° F.-650° F. | 81.75 | 374.21 |
| 650° F.-1050° F. | 32.34 | 1237.60 |
| 1050° F.-plus | — | 159.16 |

Hot separator vapors in line 8 are admixed with 2,541.88 moles/hour of an enrichment liquid in line 9, the source of which is hereinafter described. Enrichment liquid is supplied at a temperature of about 180° F. (82.2° C.) and a pressure of about 2,300 psig. (157.57 atm.). The resulting mixture, at a temperature of 540° F. (282.2° C.) and a pressure of about 2200 psig. (150.76 atm.), is introduced into cooler/condenser 10 wherein the temperature is descreased to a level of about 130° F. (54.4° C.). The thus-cooled vapors are introduced, by way of line 11 into high pressure, cold separator 12.

Principally, the function of cold separator 12 is to provide a hydrogen-rich vaporous phase which, after removal of the greater proportion of hydrogen sulfide, is at least in part recycled to the reaction zone system, and further to separate water from the normally liquid hydrocarbons. Cold separator vapors are recovered through conduit 13 and comprise about 82.8 volume percent hydrogen; this increases to about 84.3% on a hydrogen sulfide-free basis. Of the 2111.89 moles/hour of water entering cold separator 12, about 2070.81 moles (98.1%) are withdrawn by way of conduit 14. The principally liquid phase is removed by way of conduit 15, and introduced thereby into heat-exchanger 16. Through the use of suitable heat-exchange medium in line 17, such as a hot process stream or steam, the temperature of the cold separator liquid phase is raised to a level of about 363° F. (183.9° C.); the cooled heat-exchange medium is withdrawn from the separation facility through conduit 18. Cold separator stream analyses, in pound moles/hour are presented in the following Table III.

TABLE III

| Cold Separator Stream Analyses | | |
|---|---|---|
| Component | Line 13 | Line 15 |
| Water | 41.18 | — |
| Hydrogen Sulfide | 704.29 | 216.08 |
| Hydrogen | 33819.93 | 447.27 |
| Methane | 5585.03 | 321.00 |
| Ethane | 405.30 | 80.22 |
| Propane | 161.84 | 82.87 |
| Butanes | 71.58 | 87.52 |
| Pentanes | 21.90 | 74.15 |
| Hexanes | 12.09 | 92.14 |
| Heptane-400° F. | 17.79 | 1566.17 |
| 400° F.-650° F. | 0.02 | 1326.55 |
| 650° F.-1050° F. | — | 242.49 |
| 1050° F.-plus | — | — |

The heated cold separator liquid phase is introduced, via conduit 19, into warm flash zone 20 at a reduced pressure of about 300 psig. (21.42 atm.). As hereinbefore stated, the warm flash zone conditions, compared to those of the cold flash zone of prior art separation processes, favor retention of hydrogen and rejection of methane. The object being at least 70.0% removal of methane such that there is no necessity to withdraw a drag stream of warm flash liquid by way of line 22. Warm flash zone vapors are recovered through conduit 21, while the liquid phase is withdrawn via line 2. As illustrated by the warm flash zone stream analyses in Table IV, 80.1% of the methane in the cold separator liquid phase, line 19, is removed from the process through line 21. There is, therefore, no need to withdraw a drag stream via conduit 22.

Warm flash zone liquid phase components are withdrawn by way of conduit 2 in the amount of about 3499.79 moles/hour, and introduced into the suction side of enrichment pump 23 which has a discharge pressure of about 2300 psig. (157.57 atm.). About 2541.88 moles/hour, or about 72.6%, is diverted through line 9 as enrichment quench of the hot separator vapors in line 8. The remainder continues through line 2 to be combined with the reaction product effluent in line 1, thereby decreasing its temperature to about 750° F. (398.9° C.).

TABLE IV

| Warm Flash Zone Stream Analyses | | |
|---|---|---|
| Component | Line 21 | Line 2 |
| Water | — | — |
| Hydrogen Sulfide | 140.87 | 75.21 |
| Hydrogen | 402.07 | 45.20 |
| Methane | 261.00 | 60.01 |
| Ethane | 50.13 | 30.09 |
| Propane | 40.09 | 42.79 |
| Butanes | 31.45 | 56.07 |
| Pentanes | 18.32 | 55.82 |
| Hexanes | 16.36 | 75.78 |
| Heptane–400° F. | 75.50 | 1490.67 |
| 400° F.–650° F. | 0.88 | 1325.68 |
| 650° F.–1050° F. | — | 242.49 |
| 1050° F.–plus | — | — |

As hereinbefore stated, the integration of the present separation process into a 50,000 Bbl/day black oil unit affords a savings of over one-half million dollars per operating year. The foregoing specification, particularly when read in light of the drawing, clearly illustrates the method of effecting the present invention and the benefits afforded through the utilization thereof.

I claim as my invention:

1. A process for separating a mixed-phase hydrocarbonaceous reaction product effluent, said product effluent (1) resulting from the conversion of a hydrocarbon charge stock boiling above a temperature of about 400° F. and, (2) containing hydrogen to be recycled to the conversion zone, normally liquid hydrocarbons and normally vaporous hydrocarbons, which separation process comprises the sequential steps of:

(a) separating said product effluent, in a first separation zone at substantially the same pressure as said effluent, to provide (i) a first liquid phase and, (ii) a first vaporous phase;

(b) cooling said first vaporous phase to a temperature in the range of about 50° F. to about 150° F., and separating the cooled vaporous phase, in a second separation zone at substantially the same pressure as said first separation zone, to provide (i) a hydrogen-rich second vaporous phase and, (ii) a methane-containing second liquid phase;

(c) increasing the temperature of said second liquid phase, and separating the heated liquid phase, in a third separation zone at a substantially reduced pressure, said temperature and pressure being selected to provide (i) a third liquid phase and, (ii) a third vaporous phase containing at least about 70.0% of the methane in said second liquid phase; and, (d) admixing at least a portion of said third liquid phase with said first vaporous phase.

2. The process of claim 1 further characterized in that the portion of said third liquid phase is admixed with said first vaporous phase prior to effecting the cooling thereof.

3. The process of claim 1 further characterized in that said second phase is heated to a temperature in the range of about 250° F. to about 500° F., and said third separation zone functions at a pressure from about 200 psig. to about 450 psig.

4. The process of claim 1 further characterized in that a second portion of said third liquid phase is admixed with said hydrocarbonaceous reaction product effluent.

5. The process of claim 1 further characterized in that at least a portion of said first liquid phase is separated, in a fourth separation zone at substantially the same temperature as said first separation zone, under a substantially reduced pressure, to provide (i) a fourth liquid phase and, (ii) a fourth vaporous phase.

6. The process of claim 1 further characterized in that said product effluent is separated in said first separation zone at a pressure greater than about 1000 psig.

7. The process of claim 1 further characterized in that said product effluent is separated in said first separation zone at a temperature not substantially exceeding about 750° F.

8. The process of claim 5 further characterized in that said reduced pressure, in said fourth separation zone is in the range of about 100 psig. to about 400 psig.

* * * * *